US012426718B2

(12) United States Patent
Zhang et al.

(10) Patent No.: US 12,426,718 B2
(45) Date of Patent: Sep. 30, 2025

(54) MATERNITY PILLOW

(71) Applicant: Shenzhen Lute Jiacheng Supply Chain Management Co., Ltd., Shenzhen (CN)

(72) Inventors: Hanna Zhang, Shenzhen (CN); Silin Pan, Shenzhen (CN)

(73) Assignee: Shenzhen Lute Jiacheng Supply Chain Management Co., Ltd., Shenzhen (CN)

( * ) Notice: Subject to any disclaimer, the term of this patent is extended or adjusted under 35 U.S.C. 154(b) by 226 days.

(21) Appl. No.: 18/357,327

(22) Filed: Jul. 24, 2023

(65) Prior Publication Data

US 2025/0009136 A1 Jan. 9, 2025

(30) Foreign Application Priority Data

Jul. 6, 2023 (CN) ..... 202321771458.8

(51) Int. Cl.
*A47C 20/02* (2006.01)

(52) U.S. Cl.
CPC ..... *A47C 20/025* (2013.01)

(58) Field of Classification Search
CPC ... A47C 20/025; A47C 20/027; A47C 20/021; A47C 16/00; A47C 20/023; A47C 7/383; A47C 16/005; A47G 9/10; A47G 9/1081; A47G 2009/1018; A47G 9/1027; A47G 2009/003; A47G 9/00; A47G 9/1036; A47G 9/1054; Y10S 5/93; Y10T 29/49826; A47D 13/083
USPC ..... 5/632, 633, 652, 631, 655, 490, 655.5, 5/655.9, 657, 930
See application file for complete search history.

(56) References Cited

U.S. PATENT DOCUMENTS 8,136,186 B1 * 3/2012 Leach ..... A47C 7/425 5/652
9,775,452 B2 * 10/2017 Gibbons ..... A47C 20/027
D906,013 S * 12/2020 Chunyu ..... A47C 7/425 D6/601

FOREIGN PATENT DOCUMENTS

CN 209826107 U 12/2019
CN 210727394 U * 6/2020
WO WO-2019170921 A1 * 9/2019 ..... A47C 20/021

OTHER PUBLICATIONS

First Office Action issued in counterpart Chinese Patent Application No. 202321771458.8, dated Apr. 7, 2024.

* cited by examiner

*Primary Examiner* — Madison Emanski
(74) *Attorney, Agent, or Firm* — Westbridge IP LLC

(57) ABSTRACT

Disclosed is a maternity pillow. The maternity pillow includes a headrest and a side pillow. One side of the headrest is provided with two connection elements spaced apart along a length direction of the headrest. The side pillow is provided on the one side of the headrest and is detachably connected to any of the connection elements.

8 Claims, 2 Drawing Sheets

MATERNITY PILLOW

CROSS-REFERENCE TO RELATED APPLICATIONS

The present application claims priority to Chinese Patent Application No. 202321771458.8, filed on Jul. 6, 2023, the entire contents of which are incorporated herein by reference.

TECHNICAL FIELD

The present application relates to the technical field of maternity pillows, and in particular to a maternity pillow.

BACKGROUND

With the increase of gestational age, the burden on the waist and abdomen of gravida gradually increases, which is easy to cause back pain, and when the gravida lies down for a long time, it may also cause hypotension in the supine position, chest tightness, and palpitation symptoms. Therefore, gravida should adopt a side-lying sleeping position during sleep to reduce the pressure on the waist and abdomen.

In the related art, the maternity pillow usually includes a headrest and two side pillows connected side by side to the headrest. These two side pillows can respectively raise the waist and abdomen of the gravida when lying on the left or right side, thereby relieving the symptoms of back pain. However, this configuration increases the overall volume of the maternity pillow and presents difficulties in terms of storage.

SUMMARY

The main objective of the present application is to provide a maternity pillow, which aims to minimize the space occupied by the maternity pillow and improve the convenience of storing the maternity pillow.

In order to achieve the above purpose, the present application provides a maternity pillow, including: a headrest, and a side pillow provided on one side of the headrest.

The one side of the headrest is provided with two connection elements spaced apart along a length direction of the headrest, and the side pillow is detachably connected to any one of the connection elements.

In an embodiment, the side pillow includes a connection portion provided on the one side of the headrest and extended along a width direction of the headrest; and a main body portion connected to one end of the connection portion away from the headrest.

One end of the connection portion toward the headrest is detachably connected to any one of the connection elements, the main body portion is configured to surrounds a user's body side, and a thickness of the connection portion is smaller than a thickness of the main body portion to form a concave space between the main body portion and the headrest.

In an embodiment, the main body portion includes: a first body segment connected to one end of the connection portion away from the headrest and extended along the width direction of the headrest; and a second body segment curvedly connected to one side of the first body segment and extended along the length direction of the headrest.

The second body segment is opposite to the headrest along a length direction of the first body segment.

In an embodiment, one side of the first body segment connected to the second body segment is provided with a protrusion structure.

In an embodiment, the maternity pillow further includes: a waist pillow provided on a side of the headrest toward the side pillow.

The waist pillow is spaced apart from the headrest and is spaced apart from the side pillow along the length direction of the headrest.

In an embodiment, one side of the waist pillow toward the side pillow is provided with a connection piece, and one end of the connection piece away from the waist pillow is detachably connected to the side pillow.

In an embodiment, the connection piece is a belt, one end of the belt away from the waist pillow is curved to form a ring structure, and the ring structure is sleeved on the side pillow.

In an embodiment, a quantity of curls of the belt is adjustable, and/or an inner diameter of the ring structure is adjustable.

In an embodiment, the waist pillow includes a first end and a second end opposite to the first end, and the first end is connected to the connection piece; and a thickness of the waist pillow gradually increases from the first end to the second end.

In an embodiment, one side of the headrest toward the side pillow is provided with a notch structure, and the notch structure is provided between the two connection elements; and/or a top surface of the headrest is provided with a concave structure; and/or a surrounding side of the headrest is provided with a breathable structure.

In the technical solution of the present application, the maternity pillow includes a headrest and a side pillow. The headrest has two connection elements provided side by side along its length direction, and the side pillow is detachably connected to any one of the connection elements. The maternity pillow can be adapted to the postures of the gravida lying on the left or right by exchanging the connection position of the side pillow.

Compared to the technical solution in which the maternity pillow includes two side pillows, this solution reduces the overall occupied space of the maternity pillow by minimizing the quantity of side pillows. Additionally, in the present application, the side pillow is detachably connected to the headrest, such that the side pillow and the headrest can be separately stored, which enhances the convenience of storing the maternity pillow.

BRIEF DESCRIPTION OF THE DRAWINGS

In order to more clearly illustrate the technical solutions in the embodiments of the present application or related art, the following is a brief description of the drawings for the description of the embodiments or related art, it is obvious that the drawings in the following description are only some of the embodiments of the present application, other structures can be obtained by those skilled in the art according to structures in these drawings without creative works.

The realization of the purpose, functional features and advantages of the present application will be further illustrated with reference to the drawings in conjunction with the embodiments.

DETAILED DESCRIPTION OF THE EMBODIMENTS

In the present application, unless otherwise clearly specified and limited, the terms "connected", "fixed", etc. should be interpreted broadly. For example, "fixed" can be a fixed connection, a detachable connection, or a whole; can be a mechanical connection or an electrical connection; may be directly connected, or indirectly connected through an intermediate medium, and may be the internal communication between two elements or the interaction relationship between two elements, unless specifically defined otherwise. For those of ordinary skill in the art, the specific meaning of the above-mentioned terms in the present disclosure can be understood according to specific circumstances.

In addition, the descriptions such as "first" and "second" in the present application are for descriptive purposes only and are not to be construed as indicating or implying their relative importance or implicitly specifying the quantity of technical features indicated. Thus, the features defined with "first" and "second" may explicitly or implicitly include at least one such feature. Besides, the meaning of "and/or" appearing in the present application includes three parallel scenarios. For example, "A and/or B" includes only A, or only B, or both A and B. Additionally, it is contemplated that the technical solutions presented in different embodiments can be combined, provided that such combination is within the capabilities of a person skilled in the art. However, in case of any contradictory or impracticable combination of technical solutions, it shall be understood that such combination does not exist and is not within the scope of the present application.

The present application provides a maternity pillow 100.

Figure 1:
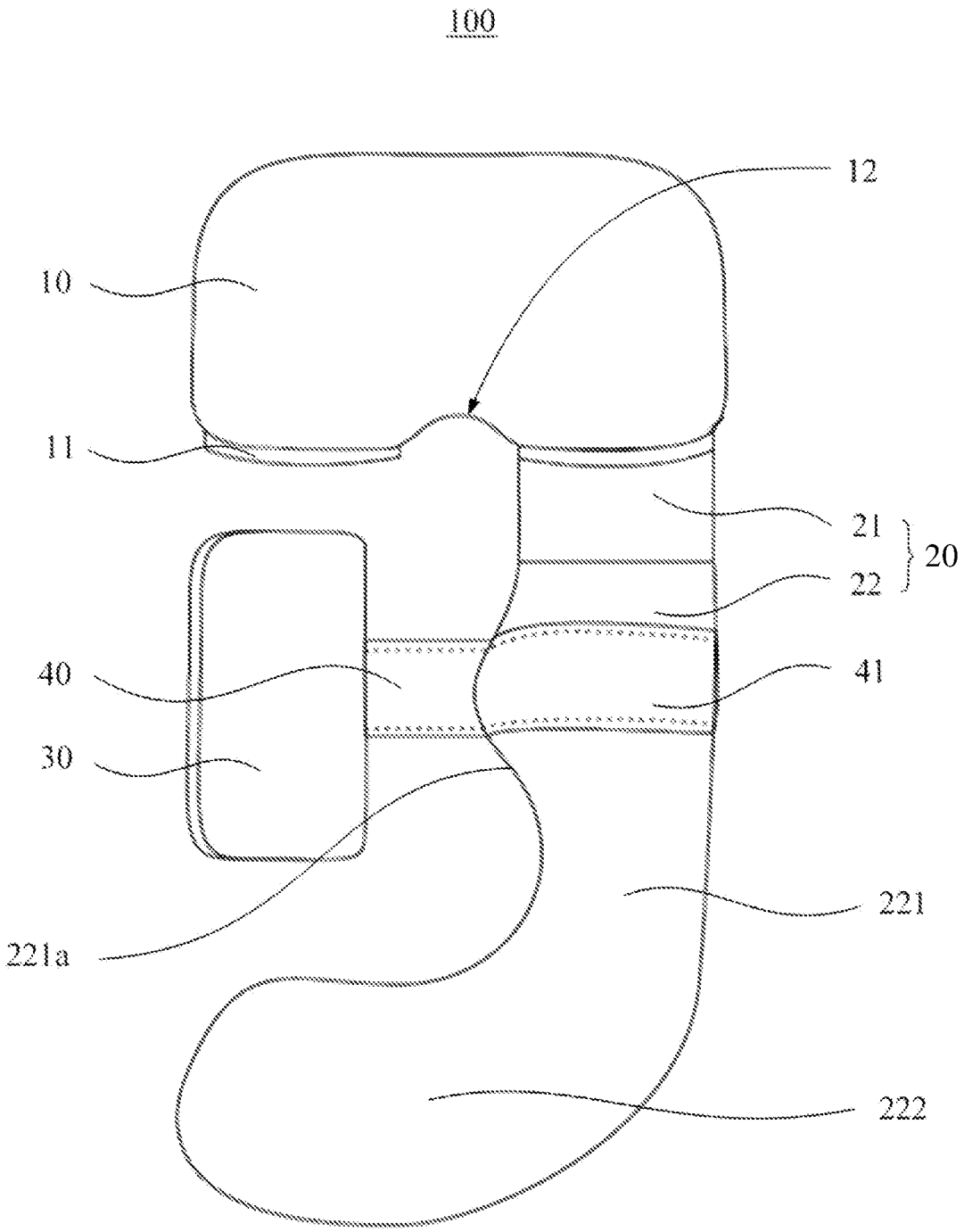
FIG. 1 is a schematic structural view of a maternity pillow in the present application.

As shown in FIG. 1, in some embodiments of the present application, the maternity pillow 100 includes a headrest 10 and a side pillow 20. One side of the headrest 10 is provided with two connection elements 11 spaced apart along a length direction of the headrest 10. The side pillow 20 is provided on one side of the headrest 10 and detachably connected to any one of the connection elements 11.

In this embodiment, the maternity pillow 100 includes a headrest 10 and a side pillow 20, one side of the headrest 10 is provided with two connection elements 11 spaced apart along its length direction, and the two connection elements 11 are located at the left end and the right end of the headrest 10 respectively. The side pillow 20 is located at one side of the headrest 10, and is detachably connected to any one of the connection elements 11, so that it can be connected to the left and right ends of the headrest 10 according to actual use requirements, which is respectively adapted to the usage posture of the gravida that lying on the left side and lying on the right side.

It should be noted that with the increase of gestational age, the burden on the waist and abdomen of gravida gradually increases, which is easy to cause back pain, and when the gravida lies down for a long time, it may also cause hypotension in the supine position, chest tightness, and palpitation symptoms. Therefore, gravida should adopt a side-lying sleeping position during sleep to reduce the pressure on the waist and abdomen. In the related art, the maternity pillow 100 usually includes a headrest 10 and two side pillows 20 connected side by side to the headrest 10. These two side pillows 20 can respectively raise the waist and abdomen of the gravida when lying on the left or right side, thereby relieving the symptoms of back pain. However, this configuration increases the overall volume of the maternity pillow 100 and presents difficulties in terms of storage.

Therefore, it can be understood that in the technical solution of the present application, the maternity pillow 100 includes a headrest 10 and a side pillow 20, the headrest 10 is provided with two connection elements 11 provided side by side along its length direction, and the side pillow 20 is detachably connected to any one of the connection elements 11. With such configuration, the maternity pillow 100 can be adapted to the postures of the gravida lying on the left or right by exchanging the connection position of the side pillow 20. Compared to the technical solution in which the maternity pillow 100 includes two side pillows 20 in the related art, this solution reduces the overall occupied space of the maternity pillow 100 by reducing the quantity of side pillows 20. Additionally, the side pillow 20 is detachably connected to the headrest 10. On the one hand, the headrest 10 can be used alone by detach the side pillow 20, so that the maternity pillow 100 can be applied to daily life in addition to being applied to the gravida's life, and the application scope and the usage convenience of the maternity pillow 100 can be improved. On the other hand, the side pillow 20 and the headrest 10 can be separately stored by disassembling the side pillow 20 and the headrest 10, so as to improve the storage convenience of the maternity pillow 100.

As shown in FIG. 1, in some embodiments of the present application, the side pillow 20 includes the connection portion 21 provided on one side of the headrest 10 and extended along the width direction of the headrest 10. One end of the connection portion 21 toward the headrest 10 is detachably connected to any one of the connection elements 11.

The side pillow further includes the main body portion 22 connected to one end of the connection portion 21 away from the headrest 10, and is configured to surround the user's body side.

The thickness of the connection portion 21 is smaller than that of the main body portion 22 to form a concave space between the main body portion 22 and the headrest 10.

In this embodiment, the side pillow 20 includes the sequentially connected connection portion 21 and the main body portion 22, the connection portion 21 is provided on one side of the headrest 10 and extended along the width direction of the headrest 10. The connection portion 21 can be detachably connected to any one of the connection elements 11 on the headrest 10. The main body portion 22 is provided on the end of the connection portion 21 away from the headrest 10, and is used to surround the user's body side, so that the waist and abdomen of the gravida can supported when lying toward the main body portion 22.

Specifically, in some embodiments, the connection portion 21 may be connected to the connection element 11 of the headrest 10 through a zipper, for example, a zipper tape may be respectively provided at the connection portion 21 and the two connection elements 11 of the headrest 10. The zipper tape at the connection portion 21 and the zipper tape at any connection element 11 are provided in pairs, and a puller is provided on the zipper tape at the connection portion 21 or the zipper tape at the connection element 11, so that the teeth of the zipper tape can be opened and closed by the puller to realize the detachable connection between the connection portion 21 and the connection element 11. The technical solution of the present application is not limited thereto, and in some practicable embodiments, the connection portion 21 and the connection element 11 can be detachably connected through but not limited to the following ways: buckle connection, snap-in connection, magnetic connection, etc. The specific implementation method can be provided according to actual needs, and is not limited here.

As shown in FIG. 1, in some embodiments of the present application, the main body portion 22 includes a first body segment 221 connected to one end of the connection portion 21 away from the headrest 10 and extended along the width direction of the headrest 10.

The main body portion 22 further includes a second body segment 222 curvedly connected to one side of the first body segment 221 and extended along the length direction of the headrest 10. The second body segment 222 is opposite to the headrest 10 along a length direction of the first body segment 221.

In this embodiment, the main body portion 22 includes the first body segment 221 and the second body segment 222. The first body segment 221 is connected to the end of the connection portion 21 away from the headrest 10 and extended along the width direction of the headrest 10 for surrounding the user's body side. The second body segment 222 is curvedly connected to one side of the first body segment 221, and is extended along the length direction of the headrest 10. The second body segment 222 is opposite to the headrest 10 along the length direction of the first main body portion 22, and is used for cushioning the lower limbs of the gravida, so as to support the leg muscles of the gravida, thereby effectively relieving leg edema and varicose veins during pregnancy.

In an embodiment, the connection portion 21 between the first body segment 221 and the second body segment 222 may be provided in an arc transition, which is conducive to making the outline of the body segment 22 fit the body curve of gravida more, to better support the limbs of the gravida, so as to improve the use comfort of the maternity pillow 100.

As shown in FIG. 1, in some embodiments of the present application, one side of the first body segment 221 connected to the second body segment 222 is further provided with a protrusion structure 221*a*.

In this embodiment, one side of the first main body portion 22 is connected to a second body segment 222, so that the second main body portion 22 is cushioned on the lower limbs of the gravida, and the side of the first main body portion 22 is further provided with a protrusion structure 221*a*. The protrusion structure 221*a* may be but not limited to be provided as an arc-shaped protrusion. With such a configuration, at least part of the structure of the first body segment 221 toward one side of the gravida is cushioned under the pregnant belly of the gravida, so as to better support the gravida's abdomen.

As shown in FIG. 1, in some embodiments of the present application, the maternity pillow 100 further includes a waist pillow 30 provided on a side of the headrest 10 toward the side pillow 20. The waist pillow 30 is spaced apart from the headrest 10, and is spaced apart from the side pillow 20 along the length direction of the headrest 10.

In this embodiment, the maternity pillow 100 further includes the waist pillow 30 provided on the side of the headrest 10 toward the side pillow 20. The waist pillow 30 is spaced apart from the headrest 10 to be cushioned on the user's waist and abdomen. In addition, the waist pillow 30 and the side pillow 20 are also spaced apart along the length direction of the headrest 10, so that the waist pillow 30 and the side pillow 20 can be respectively provided on both sides of the gravida's body when the gravida is using the pillow 100. Therefore, when the gravida is lying on her side, one of the waist pillow 30 and the side pillow 20 can be cushioned against the front side of the gravida to support the front waist and the pregnant belly, so that the other of the waist pillow 30 and the side pillow 20 is cushioned against the back side of the gravida to support the back waist and the back. That is, by providing the maternity pillow 100 with the headrest 10, the side pillow 20 and the waist pillow 30, it is possible to support the torso of the gravida in full-cover, thereby helping to improve the supporting effect of the maternity pillow 100 and usage experience.

In an embodiment, the waist pillow 30 can be detachably connected to the side pillow 20 through the connection piece 40 in the following embodiments, or can be indirectly connected to the headrest 10 through the connection piece 40, which is beneficial to improve the position stability of the waist pillow 30. Therefore, the risk of position shifting during use reducing the supporting effect is lowered, and the risk of accidental loss of the waist pillow 30 is also lowered.

Figure 2:
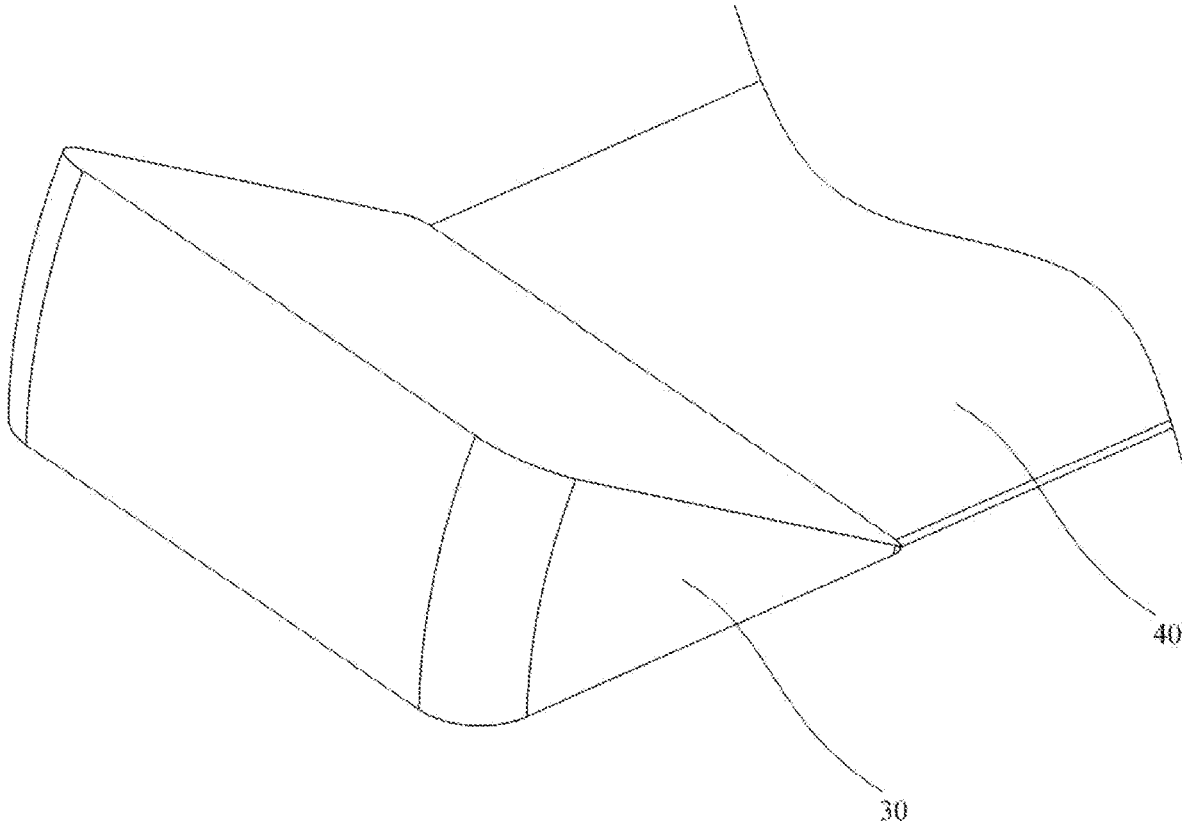
FIG. 2 is a partial structural view of the maternity pillow in FIG. 1.

As shown in FIG. 1 and FIG. 2, in some embodiments of present application, the side of the waist pillow 30 toward the side pillow 20 is provided with a connection piece 40, and one end of the connection piece 40 away from the waist pillow 30 is detachably connected to the side pillow 20.

In this embodiment, the side of the waist pillow 30 toward the side pillow 20 is provided with a connection piece 40, and one end of the connection piece 40 away from the waist pillow 30 is detachably connected to the side pillow 20. The end of the connection piece 40 away from the waist pillow 30 may be, but not limited to, detachably bonded to the side pillow 20 through a buckle structure, or may be connected to the side pillow 20 through a zipper structure, or may be but not limited to connected to the side pillow 20 through a buckle connection, magnetic connection, etc. The specific implementation method can be provided according to actual needs, and is not limited here.

In an embodiment, the end of the connection piece 40 away from the waist pillow 30 can be movably connected to the side pillow 20 so that it can move back and forth along the length direction of the side pillow 20. Therefore, the connection piece 40 can be flexibly adjusted to be connected to connection position on the side pillow 20, so that it can be accurately cushioned on the waist and abdomen of the gravida, and the flexibility of use of the maternity pillow 100 is improved.

As shown in FIG. 1, in some embodiments of the present application, the connection piece 40 is a belt. One end of the belt away from the waist pillow 30 is curved to form a ring structure 41, and the ring structure 41 is sleeved on the side pillow 20.

In this embodiment, the connection piece 40 is the belt, and the end of the belt away from the waist pillow 30 is curved to form the ring structure 41. The ring structure 41 is sleeved on the side pillow 20 and can reciprocate along the length direction of the side pillow 20. By forming the ring structure at the end of the connection piece 40, it can be conveniently sleeved on the side pillow 20, which is beneficial to improve the connection convenience between the side pillow 20 and the connection piece 40.

Further, in some embodiments, the end of the belt away from the waist pillow 30 is provided with a snap button structure. Specifically, the snap button structure includes a pair of hook and loop, which are separately provided on two opposite sides of the belt, and the hook surface of the hook can be detachably matched with the loop surface of the loop. In this way, when the end of the belt away from the waist pillow 30 is in a curving movement, the two sides of the part of the belt in the curved state can abut against each other, so that the hook surface of the hook and the loop surface of the loop are bonded with each other. Therefore, one end of the belt can be curved and enclosed to form a ring structure 41, so as to realize the function that the connection piece 40 is sleeved on the side pillow 20.

In some embodiments of the maternity pillow 100 of the present application, the quantity of curls of the belt is adjustable.

In this embodiment, the quantity of curls of the belt is adjustable, so that the length of the curl part of the belt can be increased by increasing the quantity of curls of the belt, so that the distance between the waist pillow 30 and the side pillow 20 can be pulled closer synchronously. In the same way, the length of the curl part of the belt can be shortened by reducing the quantity of curls of the belt, so that the distance between the waist pillow 30 and the side pillow 20 can be lengthened synchronously. That is, by adjusting the quantity of curls of the belt, the distance between the waist pillow 30 and the side pillow 20 can be flexibly adjusted, thereby improving the use flexibility of the waist pillow 30, so that it can be accurately cushioned on the gravida's waist and abdomen.

In some embodiments of the present application, the inner diameter of the ring structure 41 is adjustable.

In this embodiment, in order to achieve a good fit between the outline of the side pillow 20 and the body curve of the gravida, the outline of the side pillow 20 can be provided in an ergonomic arc, so the cross-joint area of the side pillow 20 is not a constant value. At this time, the inner diameter of the ring structure 41 can be adjusted so that it can better adapt to the outlines of the side pillow 20 at different positions, thereby helping to improve the connection stability between the connection piece 40 and the side pillow 20.

In an embodiment, the connection piece 40 can be provided to be elastic, so that it can be elastically deformed when it is wrapped around the periphery side of the side pillow 20, so as to be hooked on the outer periphery of the side pillow 20, which is beneficial to eliminate the installation gap between the connection piece 40 and the side pillow 20, thereby ensuring a stable connection between the connection piece 40 and the side pillow 20.

As shown in FIG. 1 and FIG. 2, in some embodiments of the present application, the waist pillow 30 includes a first end and a second end opposite to the first end, and the first end is connected to the connection piece 40.

The thickness of the waist pillow 30 is gradually increased from the first end to the second end.

In this embodiment, the waist pillow 30 includes a first end and a second end opposite to the first end, the first end of the waist pillow 30 is connected to the connection piece 40, and the thickness of the waist pillow 30 is gradually increased from the first end to the second end. Therefore, when the waist pillow 30 is placed flat with any side as the bottom surface, its top side will be inclined relative to its bottom side, so that the structure of its top side is better for abutting against the torso of gravida. Therefore, waist pillow 30 is suitable for two-way placement on the front and back sides, which is conducive to improving the usage convenience of the maternity pillow 100.

As shown in FIG. 1, in some embodiments of the present application, one side of the headrest 10 toward the side pillow 20 is provided with a notch structure 12, and the notch structure 12 is provided between the two connection elements 11.

In this embodiment, the side of the headrest 10 toward the side pillow 20 is provided with a notch structure 12 between the two connection elements 11, and the outline of the notch structure 12 is provided corresponding to the outline of the human neck, so that the notch structure 12 is provided around the neck of the human body to limit and support the neck of the gravida when using the headrest 10. By providing the notch structure 12, the shape of the headrest 10 can be more ergonomically designed to enhance the usage experience of the maternity pillow 100.

In some embodiments of the present application, the top surface of the headrest 10 is provided with a concave structure.

In this embodiment, the top surface of the headrest 10 is provided with a concave structure, which is used to limit and support the head of the gravida, and by providing the concave structure, the height of the part of the headrest 10 used for cushioning can be appropriately lowered. Therefore, when the gravida is sleeping on her side, the neck muscles and cervical spine being pulled up caused by the head being raised too high is avoided, which affects the health of the maternity pillow 100.

In some embodiments of the present application, the surrounding side of the headrest 10 is provided with a breathable structure.

In this embodiment, the headrest 10 includes an inner core and a pillowcase, and a breathable structure is provided around the pillow case. The breathable structure may be, but not limited to, provided as a breathable fabric. In some embodiments, the breathable fabric can be provided as a double-layer structure, the outer layer of fabric is provided with evenly distributed air holes, and the inner layer is made of thinner breathable fabric, so that the breathable function of the headrest 10 can be better realized. In order to avoid the accumulation of sweat at the headrest 10, the usage experience of the headrest 10 is improved.

Further, in some embodiments, the fabrics on both sides of the top and bottom sides of the pillowcase can be provided as skin-friendly fabrics, such as pure cotton fabrics, so that the headrest 10 can have a comfortable skin touch, which is conducive to improving the comfortableness of the headrest 10.

The above are only some embodiments of the present application, not to limit the scope of the present application. Any equivalent structural transformation made by using the content of the specification of the present application and the drawings under the inventive concept of the present application, or direct/indirect application in other related technical fields are included in the scope of the present application.

What is claimed is:

1. A maternity pillow, comprising:

a headrest; and a side pillow provided on one side of the headrest, wherein the one side of the headrest is provided with two connection elements spaced apart along a length direction of the headrest, and the side pillow is detachably connected to any one of the connection elements, wherein the side pillow comprises:

a connection portion provided on the one side of the headrest and extended along a width direction of the headrest; and a main body portion connected to one end of the connection portion away from the headrest, wherein one end of the connection portion toward the headrest is detachably connected to any one of the connection elements, the main body portion is configured to surrounds a body side of a user, and a thickness of the connection portion is smaller than a thickness of the main body portion to form a concave space between the main body portion and the headrest, wherein the main body portion comprises:

a first body segment connected to one end of the connection portion away from the headrest and extended along the width direction of the headrest; and a second body segment curvedly connected to one side of the first body segment and extended along the length direction of the headrest, wherein the second body segment is opposite to the headrest along a length direction of the first body segment.

2. The maternity pillow according to claim 1, wherein one side of the first body segment connected to the second body segment is provided with a protrusion structure.

3. The maternity pillow according to claim 1, further comprising:

a waist pillow provided on a side of the headrest toward the side pillow, wherein the waist pillow is spaced apart from the headrest and is spaced apart from the side pillow along the length direction of the headrest.

4. The maternity pillow according to claim 3, wherein one side of the waist pillow toward the side pillow is provided with a connection piece, and one end of the connection piece away from the waist pillow is detachably connected to the side pillow.

5. The maternity pillow according to claim 4, wherein the connection piece is a belt, one end of the belt away from the waist pillow is curved to form a ring structure, and the ring structure is sleeved on the side pillow.

6. The maternity pillow according to claim 5, wherein a quantity of curls of the belt is adjustable, and/or an inner diameter of the ring structure is adjustable.

7. The maternity pillow according to claim 4, wherein: the waist pillow comprises a first end and a second end opposite to the first end, and the first end is connected to the connection piece; and a thickness of the waist pillow increases from the first end to the second end.

8. The maternity pillow according to claim 1, wherein:

one side of the headrest toward the side pillow is provided with a notch structure, and the notch structure is provided between the two connection elements; and/or a top surface of the headrest is provided with a concave structure; and/or a surrounding side of the headrest is provided with a breathable structure.

* * * * *